United States Patent [19]

Sterrett

[11] 4,111,279

[45] Sep. 5, 1978

[54] LOUVER FLOW MUFFLER

[75] Inventor: Dale E. Sterrett, Grass Lake, Mich.

[73] Assignee: Tenneco Inc., Racine, Wis.

[21] Appl. No.: 708,513

[22] Filed: Jul. 26, 1976

[51] Int. Cl.[2] ..... F01N 1/00

[52] U.S. Cl. ..... 181/264; 181/273; 181/275

[58] Field of Search ..... 181/57, 56, 59, 53, 181/48, 61, 63, 250, 266, 276, 249, 264, 265, 268, 269, 272-275

[56] References Cited

U.S. PATENT DOCUMENTS

| | | | |
|---|---|---|---|
| 2,357,791 | 5/1944 | Powers | 181/266 |
| 3,589,469 | 6/1971 | Hasui et al. | 181/54 |

*Primary Examiner*—L. T. Hix

*Assistant Examiner*—Benjamin R. Fuller

*Attorney, Agent, or Firm*—Harness, Dickey & Pierce

[57] ABSTRACT

A muffler for lowering the exhaust gas noise level of combustion engines has a Helmholtz resonator chamber and a single straight tube member that is provided with a perforated portion outside said chamber large enough for full flow through it of all gas flowing through the muffler, one end of the tube extending into the resonator chamber and the tube diameter, chamber volume, and length of the tube between said one end and said perforated portion being related to and dependent upon each other in accordance with the Helmholtz formula so that the resulting Helmholtz system attenuates a predetermined frequency when the muffler is placed in an exhaust system at or near the pressure antinode of that frequency.

9 Claims, 2 Drawing Figures

LOUVER FLOW MUFFLER

BRIEF SUMMARY OF THE INVENTION

It is the purpose of this invention to simplify and reduce the weight and cost of mufflers of the type used in combustion engine exhaust systems.

The invention accomplishes this by eliminating a tube and partition as compared with conventional muffler constructions wherein attenuation of a preselected frequency is achieved by means of a Helmholtz resonator system. The omission of these parts without the loss of their function is made possible by the use of a single gas flow tube member with a perforated portion that accommodates full gas flow through the tube wall and a section extending from the perforated portion into the Hemholtz chamber to form a tuning tube having a length and inside diameter that are properly related to the volume of the chamber to satisfy the requirements of the Helmholtz formula to enable the resulting Helmholtz system to attenuate a preselected frequency.

Means, in the form of circmferentially spaced holes in the tuning tube portion of the gas flow tube, are disclosed for optional usage if it is desired to raise the tuned frequency to a small degree above that dictated by the Helmholtz formula.

Figure 1:
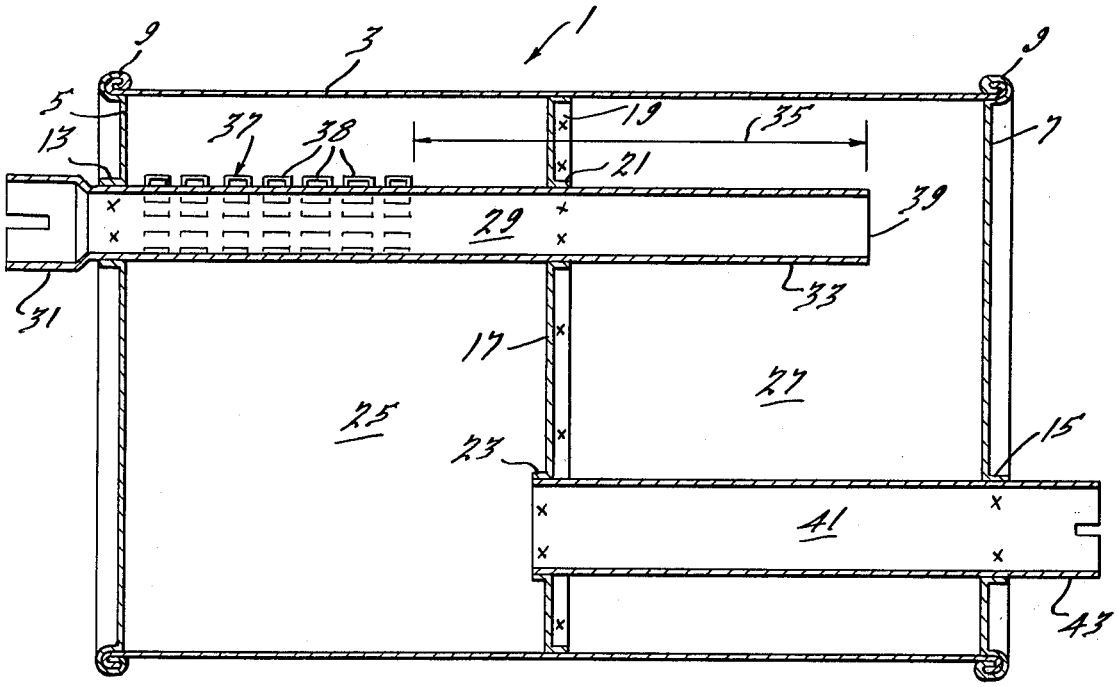
FIG. 1 is a longitudinal cross section through a metal exhaust muffler of any desired transverse cross section embodying the invention.

In the drawings the "x" indicates a weld, preferably a spotweld, or the equivalent.

DESCRIPTION OF THE INVENTION

Referring to the simplified muffler construction 1 of FIG. 1, there is an imperforate, elongated, uniform cross sectional area tubular metal housing or shell 3 which can be of any desired cross sectional shape, ordinarily round or oval. Its ends are closed by the usual end header partitions 5 and 7 which are connected to the shell in gas tight joints 9, such as the reversely bent metal to metal interlocks illustrated. Each header is imperforate except for collars or necks 13 and 15, respectively. A transverse wall or partition 17 inside the shell extends across it and has a circumferential flange 19 shaped to fit the inner wall of the shell and is spotwelded to it. The partition has collars or necks 21 and 23 aligned respectively with collars 13 and 15 and is otherwise completely or substantially completely imperforate and therefore subdivides the shell interior into a flow chamber 25 and a separate resonator chamber 27.

A round, straight, gas flow tube 29, open at both ends, is supported in the aligned collars 13 and 21 and is welded to collar 13 and preferably to collar 21. A portion 31 of the tube 28 extends outside of the chamber 25 and may be enlarged to form a bushing that can be clamped or attached in a conventional manner to another conduit in a combustion engine exhaust gas silencing system. At the other end of the tube 29 a portion 33 extends into the chamber 27. There is an imperforate length of tube 29, designated by the arrowed line 35, between the inner end of a patch 37 of louvers 38 which preferably are in rows extending entirely around the circumference of the tube, or other form of perforations, and the end 39 that is in the chamber 27. The tube length 35 functions as a tuning tube in a desired proportional relationship with its radius or cross sectional area and the volume of chamber 27 to form a Helmholtz resonator system to tune out or attenuate a predetermined low frequency sound in the exhaust system. An acoustic analysis of the combustion engine and exhaust system to be silenced reveals to the acoustic engineer in cps (cycles per second) the troublesome low frequency to be attenuated and the location of its pressure nodes and antinodes in the system. The frequency attenuated by a single Helmholtz chamber or tuner is given by the conventional Helmholtz formula:

$$F = \frac{V}{2\pi}\sqrt{\frac{\pi R^2}{Q(L + \frac{\pi R}{2})}}$$

where

F is the tuning frequency in cps;

V is the velocity of sound in feet per second;

Q is the volume of chamber 27 in cubic inches;

L is the length 35 in inches; and

R is the inside radius of tube portion 35 in inches.

Using this formula and knowing the frequency to be attenuated and the velocity of sound at the temperatures with which he is concerned, the acoustic engineer is able to select the length 35, radius of tube portion 35, and volume of chamber 27 (or position of partition 17) in the proper proportions and relationships to attenuate the desired frequency when the Helmholtz chamber is located at or near a pressure antinode for that frequency. The total outlet area of all the perforations or louvers 38 in the louver patch 37 is preferably 100–110% of the cross sectional area of the tube 29 to minimize back pressure so this in large measure controls the length of the patch 37. This length in combination with the length 35 determines at least the minimum length of the tube 29 that is within the shell. The radius of the tube 29 is more or less fixed by the volume of gas flow and the back pressure requirements of the combustion engine to which the muffler is connected.

It is apparent that the partition 17 provides no other gas flow outlet for chamber 27 than the tube 29 so that gas flowing through the muffler must pass through the louvers 38 into or out of the chamber 25, depending upon whether tube 29 is the inlet or outlet tube for the muffler 1. A second gas flow tube 41 open at each end is supported in collars 15 and 23, being welded to collar 15 and preferably also to collar 23, and has a bushing portion 43 outside the shell 3 to serve as a means for connecting the muffler and the gas in chamber 25 into the exhaust system. Tube 41 extends through resonator chamber 27 but is imperforate in the chamber. Tube 41 is shown as somewhat larger in diameter than tube 29 so that the particular muffler construction illustrated is especially adapted for flow wherein tube 29 is the inlet and tube 41 is the outlet. In this case the chamber 27 is a driven tuner since the inlet gas stream flows directly down tube 29 into chamber 27.

However, the flow can also be in the reverse direction wherein tube 41 is the inlet and tube 29 is the outlet, in which case the relative cross sectional areas of the tubes would preferably be reversed. In this latter case, the tuner 27 would be an aspirating type tuner, since gas flow would tend to evacuate it rather than fill it, and the muffler 1 would preferably be located as far from the outlet to the exhaust system as possible for maximum efficiency of the Helmholtz system. Where the tuner is driven, i.e., tube 29 is the inlet, the muffler can be located close to the outlet end of the exhaust, e.g., downsteam of the over-the-axle kick-up in automotive exhaust systems, provided, of course, it is still at or near a pressure antinode for the frequency to which it is tuned.

The present invention which uses one tube 29 to provide a full flow gas path via perforations or louvers 38 as well as a tuning tube section 35 for the chamber 27 is in contrast to the usual arrangement wherein a separate tube and partition to support it are used to provide the Helmholtz resonator. U.S. Pat. No. 3,583,534 to Bert DuBois, issued June 8, 1971, shows a Helmholtz tuning tube 63 of the conventional type and arrangement. By means of the invention it is possible to reduce the number of parts in and the weight of a muffler, as compared with the conventional prior art arrangement, and still have a Helmholtz system for attenuation of preselected and predetermined low frequencies.

The path of gas flow through the muffler is to or from tube 29 through the various small area perforations or openings provided by the louvers 38 to or from the relatively large volume flow chamber 25 and to or from tube 41. The drastic changes in cross sectional area encountered by the gas flowing through the muffler absorb considerable sound energy and effectively lower sound levels so that the muffler may be designed to meet requirements in the medium and high frequency ranges, i.e., about 700–4000 Hz. This attenuation plus the attenuation in the low frequency range, about 40–700 Hz., provided by the Helmholtz system make the construction an efficient muffler unit in terms of decibels of sound removal per unit weight or cost.

Figure 2:
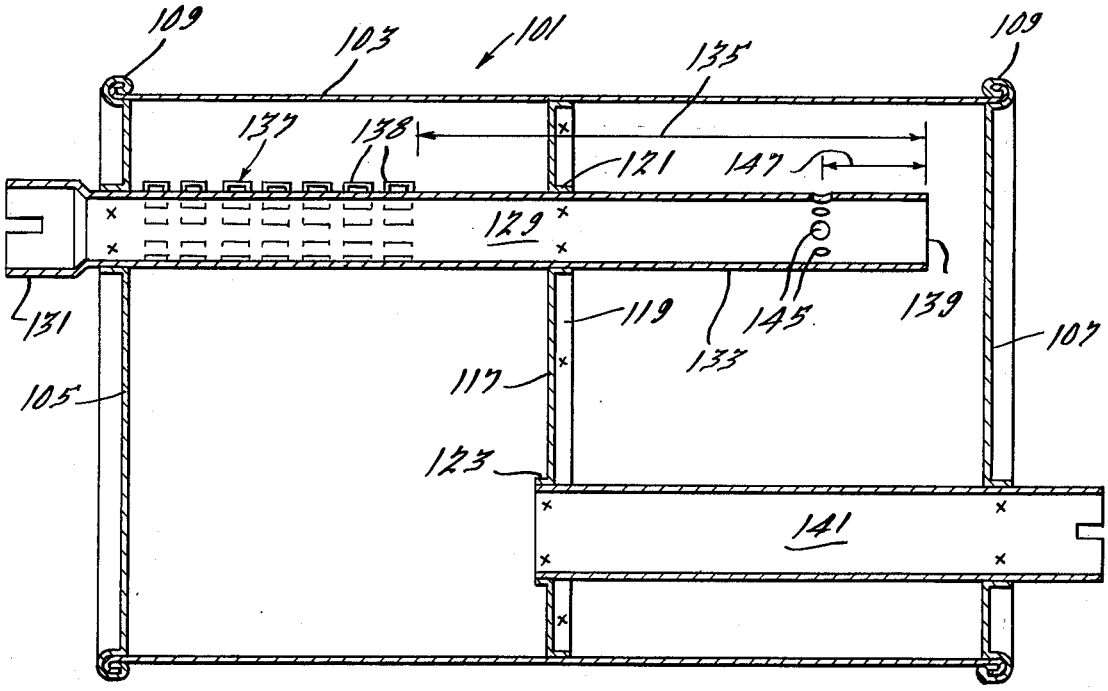
FIG. 2 is a section similar to that of FIG. 1 but showing a modification.

FIG. 2 illustrates a muffler that is substantially identical to muffler 1 so the same reference numerals are used but in the 100 series and the previous description is applicable. The difference between the muffler 1 of FIG. 1 and the muffler 101 of FIG. 2 is primarily in the series of holes 145 that are circumferentially spaced around the portion 133 of tube 129 at a distance 147 from its end 139; and there is a minor difference in that end 139 is closer to header 107, i.e., tube 129 is longer. The purpose of the holes 145 is to increase the resonant frequency of the Helmholtz system (by, in effect, shortening the tuning length) when for some reason it is necessary to make the distance 135 so long that the frequency is lower than desired. One reason may be that in a specific type of design the end of louver patch 37 will be located farther from the partition 17 than the required tuning tube length. Another, as illustrated in FIG. 2, may be that if tube 129 is used as an inlet in certain applications it would be desirable to have end 139 close to header 107 so as to take advantage of sound energy loss due to impingement of gas pulses against the header. The distance 147 and the size and total area or number of holes will, at the present time, have to be selected on an experimental or cut and try basis since the exact mathematical relationships or parameters are not known.

On the other hand, if it is desired to lower the tuning frequency of the Helmholtz system, the tube 29 along length 35, or some lesser portion of the tube length 35 but terminatng in outlet 39 (such as portion 33) can be of a smaller diameter than the remainder of the tube, the exact diameter being selected to satisfy the Helmholtz relationship as set forth above. Alternatively, for lower frequency tuning, the end of the tube 29 and the inlet end of a second and smaller diameter tuning tube could both be supported in and/or by collar 21 of partition 17, thereby forming a louvered tubular gas flow member which provides both full gas flow and tuning and eliminates the need for one partition of the conventional arrangement as shown in the DuBois patent referred to above.

The mufflers 1 and 101 are of simple construction and it is contemplated that the tubes 29 or 129, or their equivalents, in combination with a substantially closed chamber 27, all related in accordance with the Helmholtz formula, be used in many other specific constructions. Additional components will in many, if not most, cases be added to remove more sound energy and lower the sound level in terms of instrument measured decibels as well as to meet subjective noise level requirements. For example, tubes 41 and 141 could be perforated and imperforate shells mounted on them around the perforations to form so called "spit chambers" as shown at 49 in U.S. Pat. No. 3,557,905 to Paul A. Rutt, issued Jan. 26, 1971. Further, the louver constructions can vary widely or simple holes in the wall of tube 29 through area 37 may be used if satisfactory sound attenuation is obtained with them. Hence, the structures shown are illustrative of preferred simplified forms of the invention but modifications and additions are within its spirit and scope.

I claim:

1. In a muffler for reducing the noise level of combustion engine exhaust gases and for attenuating a preselected low frequency sound, the combination of a housing having port means forming an inlet and port means forming an outlet for gas flowing through the muffler, substantially imperforate partition means forming a resonator chamber in the housing, said housing having a gas flow space outside said resonator chamber, a single gas flow tube member with a wall and open at both ends and having one end portion connected to a port means and the other end portion extending into and opening into said resonator chamber and supported on said partition means. said gas flow tube member having an intermediate portion between said end portions and located outside of said chamber and said intermediate portion being in the path of gas flowing between the inlet and the outlet and said intermediate portion including a gas flow through section in said space containing a multiplicity of small area sound attenuating perforations in said wall having a total open area substantially equal to the cross sectional area of that section of the tube member and providing passage for substantially all the gas flowing through the muffler to flow between the inside and the outside of the tube member through said wall at said section, the length of the tube member between the end thereof in said resonator chamber and the adjacent end of said perforated section as well as the inside diameter of said tube member throughout said length and the volume of said resonator chamber all being interrelated and interdependent in accordance with the Helmholtz formula whereby they serve to form a Helmholtz system to attenuate said preselected low frequency, and a gas flow conduit open at both ends and supported on said partition means and extending through said resonator chamber and having one end portion connected to the other of said port means and the other end portion opening into said gas flow space whereby gas may flow between it and said perforations.

2. A muffler as set forth in claim 1 wherein said wall forming said end portion of the tube member that extends into said resonator chamber is imperforate.

3. A muffler as set forth in claim 1 wherein said wall forming said end portion of the tube member that extends into said resonator chamber has a multiplicity of spaced openings formed through it and defining a circumferential ring around the tube member, said ring being spaced a substantial distance away from the end of the tube member but inside the resonator chamber and serving to raise the frequency attenuated by the Helmholtz system above that determined by the Helmholtz formula.

4. In a muffler for reducing the noise level of combustion engine exhaust gases and for attenuating a preselected low frequency sound, the combination of a housing having inlet means and outlet means for gas flowing through the muffler, substantially imperforate partition means forming a resonator chamber in the housing, a single gas flow tube member open at both ends and having an end portion extending into and opening into said resonator chamber and supported on said partition means, said gas flow tube member having another portion located outside of said resonator chamber and said portion being in the path of gas flowing between the inlet means and outlet means and said portion including a section containing a multiplicity of small area sound attenuating perforations having a total open area substantially equal to the cross sectional area of that section of the tube member and providing for full gas flow between the inside and the outside of the tube member, the length of the tube member between the end thereof in said chamber and the adjacent end of said perforated section as well as the inside diameter of said tube member throughout said length and the volume of said resonator chamber all being interrelated and interdependent in accordance with the Helmholtz formula whereby they serve to form a Helmholtz system to attenuate said preselected low frequency, the wall of said end portion of the tube member that extends into said resonator chamber having a multiplicity of spaced openings formed through the wall thereof and defining a circumferential ring around the tube member, said ring being spaced a substantial distance away from the end of the tube member and serving to raise the frequency attenuated by the Helmholtz system above that determined by the Helmholtz formula.

5. In a muffler for reducing the noise level of combustion engine exhaust gases and for attenuating a preselected low frequency sound, the combination of a housing having inlet means and outlet means for gas flowing through the muffler, substantially imperforate partition means forming a resonator chamber in the housing, an inlet conduit connected to said inlet means to receive all gas flowing into the muffler, said conduit including a gas flow tube member having an open end portion extending into and opening into said resonator chamber, said tube being supported on said partition means, said housing having a gas flow space outside said resonator chamber and said gas flow tube member having an intermediate portion located in said space and said intermediate portion including a section containing a multiplicity of small area louvers having a total open area substantially equal to the cross sectional area of that section of the tube member and providing passage for subsantially all the gas flowing into said conduit to flow from the inside to the outside of the tube member through said louvers into said space, the length of the tube member between the end thereof in said resonator chamber and the adjacent end of said louvered section as well as the inside diameter of said tube member throughout said length and the volume of said resonator chamber all being interrelated and interdependent in accordance with the Helmholtz formula whereby they serve to form a Helmholtz system to attenuate said preselected low frequency, and an outlet conduit connected to said outlet means to receive all gas flowing through said muffler, said conduit being supported on said partition means and extending through said resonator chamber and having an inlet in said gas flow space.

6. In a muffler for reducing the noise level of combustion engine exhaust gases and for attenuating a preselected low frequency sound, the combination of a housing having inlet means and outlet means for gas flowing through the muffler, substantially imperforate partition means forming a resonator chamber in the housing, an outlet conduit connected to said outlet means to conduct all gas flowing through the muffler, said conduit including a gas flow tube member having an open end portion extending into and opening into said reasonator chamber, said tube being supported on said partition means, said housing having a gas flow space outside said resonator chamber and said gas flow tube member having an intermediate portion located in said space, an inlet conduit connected to said inlet means to receive all gas flowing into the muffler and extending through said resonator chamber and having an outlet in said gas flow space, the intermediate portion of said tube including a section containing a multiplicity of small area louvers having a total open area substantially equal to the cross sectional area of that section of the tube member and providing passage for substantially all the gas flowing into said space to flow from the outside to the inside of said tube member through said louvers, the length of the tube member between the end thereof in said resonator chamber and the adjacent end of said louvered section as well as the inside diameter of said tube member throughout said length and the volume of said resonator chamber all being interrelated and interdependent in accordance with the Helmholtz formula whereby they serve to form a Helmholtz system to attenuate said preselected low frequency.

7. An acoustic muffler for use in exhaust systems or combustion engines to provide sound attenuation in the medium and high frequency range of about 700–4000 Hz and in the low frequency range of about 40–700 Hz comprising an elongated housing defining an internal cavity and having a longitudinal axis, said housing having an inlet for gas at one end and an outlet for gas at the other end, transverse partition means in said housing extending transversely to said axis across the width of the housing and subdividing said cavity into a resonator chamber and a gas flow space, a tubular inlet conduit joined to said inlet to carry substantially all gas flowing into the muffler, a tubular outlet conduit joined to said outlet to carry substantially all gas flowing out of the muffler, said conduits being supported on the partition means and extending lengthwise of said housing and substantially parallel to said axis and being longitudinally overlapping and transversely separated, one of said conduits having an end portion opening into said resonator chamber and an intermediate portion located in said gas flow space, said intermediate portion including a section containing a multiplicity of small area louvers having a total open area substantially equal to the cross sectional area of that section of the conduit and providing a passage for substantially all the gas flowing through the muffler to flow between the inside and the outside of the conduit through said louvers, the length of the one conduit betweeen the end thereof in said resonator chamber and the adjacent end of said louvered section as well as the inside diameter of said conduit throughout said length and the volume of said resonator chamber all being interrelated and interdependent in accordance with the Helmholtz formula to form a Helmholtz system to substantially attenuate a preselected low frequency in said range of about 40–700 Hz, the other of said conduits extending through said resonator chamber and opening said gas flow space, said gas flow space providing a longitudinal and transverse path for gas to flow from the inlet conduit to the outlet conduit and acting in combination with said louvers and said conduits to provide substantial sound attenuation in the range of about 700–4000 Hz.

8. A muffler as set forth in claim 7 wherein the one of said conduits having the louvers therein is the inlet conduit and said louvers providing an outlet for substantially all gas flowing through the conduit to enter said gas flow space.

9. A muffler as set forth in claim 7 wherein the one of said conduits having the louvers therein is the outlet conduit and said louvers providing an inlet for substantially all gas flowing through the gas flow space to enter said outlet conduit.

* * * * *